US010625979B2

(12) United States Patent
Iio

(10) Patent No.: US 10,625,979 B2
(45) Date of Patent: Apr. 21, 2020

(54) ELEVATOR CONTROL SYSTEM

(71) Applicant: Mitsubishi Electric Corporation, Chiyoda-ku (JP)

(72) Inventor: Mitsutoshi Iio, Aichi (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 381 days.

(21) Appl. No.: 15/542,521

(22) PCT Filed: Mar. 11, 2015

(86) PCT No.: PCT/JP2015/057149
§ 371 (c)(1),
(2) Date: Jul. 10, 2017

(87) PCT Pub. No.: WO2016/143091
PCT Pub. Date: Sep. 15, 2016

(65) Prior Publication Data

US 2018/0265329 A1 Sep. 20, 2018

(51) Int. Cl.
*B66B 1/46* (2006.01)
*B66B 1/14* (2006.01)

(52) U.S. Cl.
CPC ..... *B66B 1/468* (2013.01); *B66B 1/14* (2013.01); *B66B 2201/4623* (2013.01); *B66B 2201/4646* (2013.01)

(58) Field of Classification Search
CPC ..... B66B 1/468; B66B 1/14
(Continued)

(56) References Cited

U.S. PATENT DOCUMENTS 4,365,694 A * 12/1982 Bittar ..... B66B 1/18 187/381
5,865,274 A * 2/1999 Kiji ..... B66B 1/2458 187/249

(Continued)

FOREIGN PATENT DOCUMENTS

EP 1 930 277 A1 6/2008
JP 02-239075 A 9/1990

(Continued)

OTHER PUBLICATIONS

Korean Office Action dated May 28, 2019 in Patent Application No. 10-2017-7026235, 8 pages (with unedited computer generated English translation).

(Continued)

*Primary Examiner* — David S Warren
(74) *Attorney, Agent, or Firm* — Oblon, McClelland, Maier & Neustadt, L.L.P.

(57) ABSTRACT

There is provided an elevator control system capable of improving operation efficiency of an elevator. The elevator control system includes a processor; and a memory to store a program which performs processes of recognizing a floor based on information from in a car of an elevator during travel of the car, determining a destination floor based on the floor recognized, determining whether or not the destination floor determined during the travel of the car, and registering a call corresponding to the destination floor in the car during the travel of the car in a case where the destination floor is determined to be the stoppable floor. The program performs processes of, in a case where the destination floor is not determined to be the stoppable floor, registering the call corresponding to the destination floor in the car after the car responds to all calls registered in the car.

12 Claims, 9 Drawing Sheets

(58) Field of Classification Search
USPC ..... 187/380
See application file for complete search history.

(56) References Cited

U.S. PATENT DOCUMENTS

| | | | | |
|---|---|---|---|---|
| 5,955,708 | A * | 9/1999 | Amano | B66B 1/18 187/247 |
| 6,419,051 | B2 * | 7/2002 | Mori | B66B 1/2458 187/247 |
| 6,905,003 | B2 * | 6/2005 | Hirade | B66B 1/18 187/247 |
| 8,678,142 | B2 * | 3/2014 | Takeuchi | B66B 1/468 187/247 |
| 9,079,752 | B2 * | 7/2015 | Takeshima | B66B 1/2458 |
| 2004/0154872 | A1 * | 8/2004 | Hirade | B66B 1/18 187/383 |
| 2011/0168499 | A1 * | 7/2011 | Takeuchi | B66B 1/468 187/389 |
| 2012/0168261 | A1 * | 7/2012 | Takeshima | B66B 1/2458 187/385 |
| 2016/0200547 | A1 * | 7/2016 | Nagata | B66B 1/468 187/380 |
| 2018/0265329 | A1 * | 9/2018 | Iio | B66B 1/14 |
| 2019/0344999 | A1 * | 11/2019 | Iio | B66B 1/468 |
| 2020/0031618 | A1 * | 1/2020 | Singaraju | B66B 5/0012 |

FOREIGN PATENT DOCUMENTS

| | | | |
|---|---|---|---|
| JP | 03-243573 | A | 10/1991 |
| JP | 04-345479 | A | 12/1992 |
| JP | 2010-254461 | A | 11/2010 |
| JP | 2013-052957 | A | 3/2013 |
| KR | 10-2007-0088756 | A | 8/2007 |
| WO | 2010/038304 | A1 | 4/2010 |

OTHER PUBLICATIONS

International Search Report dated Jun. 16, 2015 in PCT/JP2015/057149, filed on Mar. 11, 2015.
Office Action dated Dec. 3, 2018 in German Patent Application No. 11 2015 006 293.9 with partial English translation.
Japanese Office Action dated Oct. 31, 2017 in Japanese Patent Application No. 2017-504500 (with unedited computer generated English translation).
International Preliminary Report on Patentability dated Sep. 21, 2017 in PCT/JP2015/057149 (submitting English translation only).

* cited by examiner

ELEVATOR CONTROL SYSTEM

FIELD

The invention relates to an elevator control system.

BACKGROUND

PTL 1 discloses an elevator control system. The control system disables voice recognition during travel of a car. Accordingly, it is possible to prevent erroneous recognition caused by noise of a moving car.

CITATION LIST

Patent Literature

[PTL 1] Japanese Patent Application Laid-open No. 2013-52957

SUMMARY

Technical Problem

However, in the control system, it is not possible to register a call by the voice recognition during the travel of the car. As a result, operation efficiency of an elevator is reduced.

The invention has been made in order to solve the above problem. An object of the invention is to provide an elevator control system capable of improving the operation efficiency of the elevator.

Solution to Problem

An elevator control system according to the invention includes a voice input section provided in a car of an elevator, the voice input section receiving an input of a voice uttered in the car during travel of the car, a voice recognition section configured to recognize a floor based on the voice input to the voice input section, a destination floor determination section configured to determine a destination floor based on the floor recognized by the voice recognition section, a stoppable floor determination section configured to determine whether or not the destination floor determined by the destination floor determination section is a stoppable floor during the travel of the car, and a call registration section configured to register a call corresponding to the destination floor in the car during the travel of the car in a case where the destination floor is determined to be the stoppable floor by the stoppable floor determination section.

Advantageous Effects of Invention

According to the invention, even during the travel of the car, the call corresponding to the destination floor is registered in the car. Accordingly, it is possible to improve the operation efficiency of the elevator.

DESCRIPTION OF EMBODIMENTS

Figure 1:
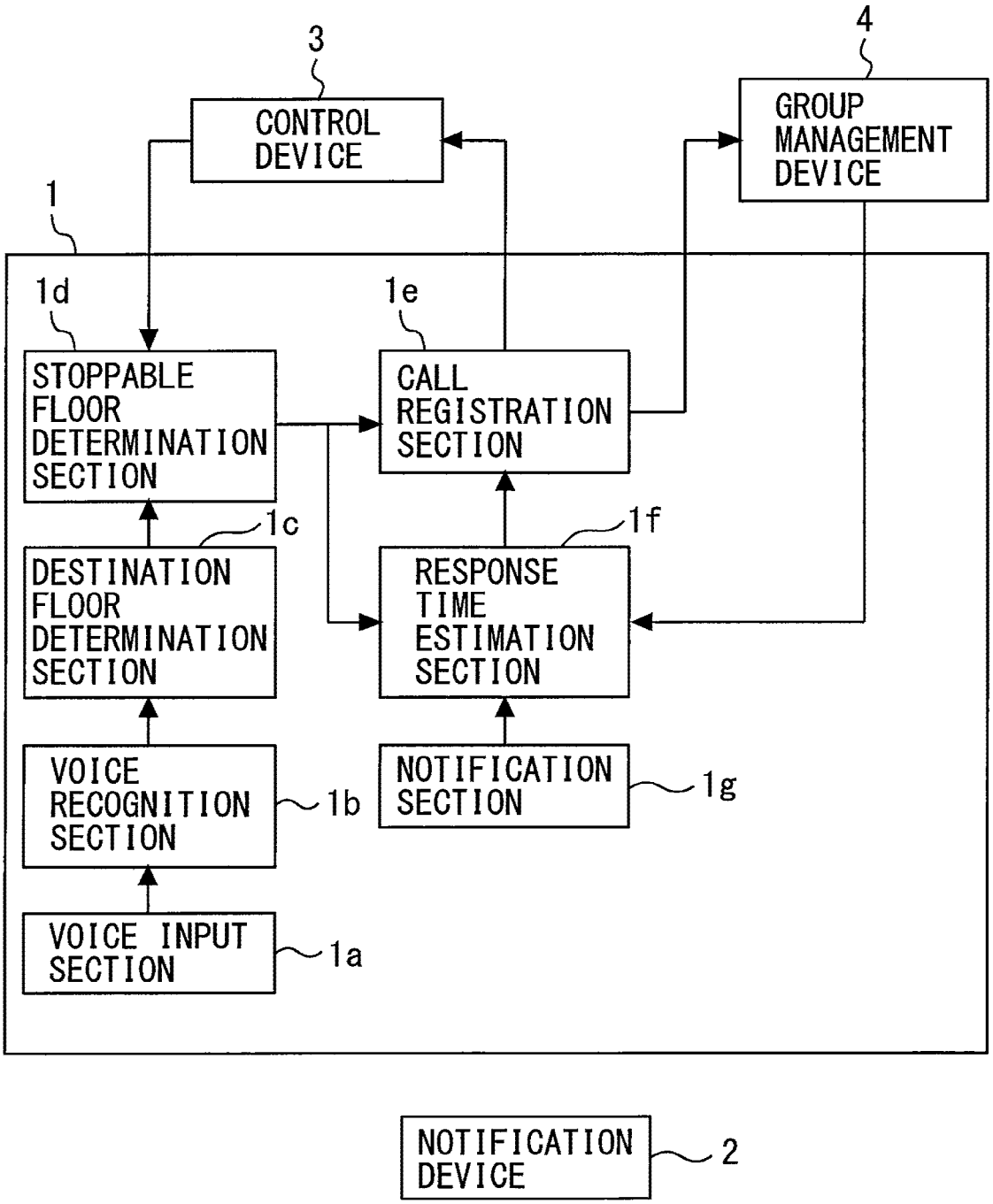
FIG. 1 is a block diagram of a control system of an elevator to which an elevator control system in Embodiment 1 of the invention is applied.

Embodiments of the invention will be described according to the accompanying drawings. Note that, in each drawing, the same or corresponding parts are designated by the same reference numerals. Redundant description of the parts will be appropriately simplified or omitted.

Embodiment 1

FIG. 1 is a block diagram of a control system of an elevator to which an elevator control system in Embodiment 1 of the invention is applied.

In FIG. 1, a hoistway that is not shown passes through individual floors of a building. A plurality of cars that are not shown are provided in the hoistway. Each car moves up and down vertically in the hoistway.

The elevator control system includes a plurality of car control panels 1, a plurality of notification devices 2, a plurality of control devices 3, and a group management device 4. Note that FIG. 1 shows one car control panel 1, one notification device 2, and one control device 3. Each car control panel 1 is provided in each car. Each notification device 2 is provided in each hall. Each control device 3 is provided so as to correspond to each car. The group management device 4 is connected to each car control panel 1.

Each car control panel 1 includes a voice input section 1*a*, a voice recognition section 1*b*, a destination floor determination section 1*c*, a stoppable floor determination section 1*d*, a call registration section 1*e*, a response time estimation section 1*f*, and a notification section 1*g*.

The voice input section 1*a* receives an input of a voice uttered in a car during travel of the car. The voice recognition section 1*b* recognizes a floor based on the voice input to the voice input section 1*a*. Specifically, the voice recognition section 1*b* recognizes the floor based on the result of comparison between information on the voice input to the voice input section 1*a* and pre-stored floor information.

The destination floor determination section 1*c* determines a destination floor based on the floor recognized by the voice recognition section 1*b*. The stoppable floor determination section 1*d* determines whether or not the destination floor determined by the destination floor determination section 1*c* is a stoppable floor during the travel of the car. Specifically, the stoppable floor determination section 1*d* determines whether or not the destination floor is the stoppable floor based on the travel state of the car acquired from the control device 3.

In the case where the destination floor is determined to be the stoppable floor by the stoppable floor determination section 1*d*, the call registration section 1*e* registers a call corresponding to the destination floor in the car during the travel of the car. At this point, the control device 3 causes the car to travel based on the call registered by the call registration section 1*e*.

In the case where the destination floor is not determined to be the stoppable floor by the stoppable floor determination section 1*d*, the response time estimation section 1*f* estimates a first response time until the travel state of the car is changed and the car arrives at the destination floor. At this point, the call registration section 1*e* registers the call determined based on the first response time estimated by the response time estimation section 1*f* in the car. Each of the notification section 1*g* and the notification device 2 provides a notification of information corresponding to the call determined based on the first response time estimated by the response time estimation section 1*f*.

Next, examples of the car control panel 1, the control device 3, and the group management device 4 will be described by using FIG. 2.

Figure 2:
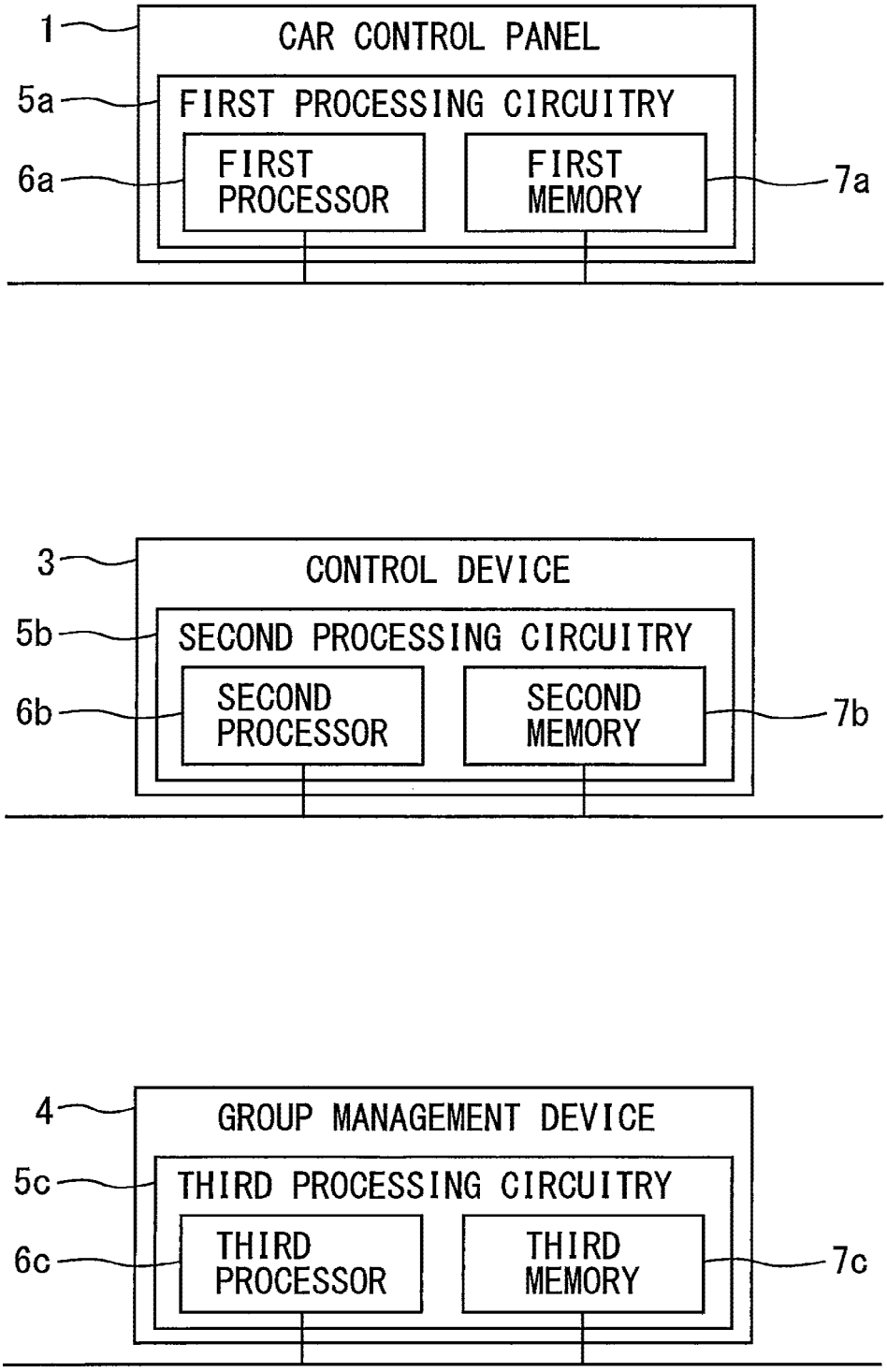
FIG. 2 is a hardware configuration diagram of each of a car control panel, a control device, and a group management device in the elevator control system in Embodiment 1 of the invention.

FIG. 2 is a hardware configuration diagram of each of the car control panel, the control device, and the group management device in the elevator control system in Embodiment 1 of the invention.

The car control panel 1 includes a first processing circuit 5*a*. The first processing circuitry 5*a* includes at least one first processor 6*a* and at least one first memory 7*a*. Each of the operations of the voice recognition section 1*b*, the destination floor determination section 1*c* the stoppable floor determination section 1*d*, the call registration section 1*e*, and the response time estimation section 1*f* is implemented by execution of a program stored in at least one first memory 7*a* by at least one first processor 6*a*.

The control device 3 includes a second processing circuitry 5*b*. The second processing circuitry 5*b* includes at least one second processor 6*b* and at least one second memory 7*b*. The operation of the control device 3 is implemented by execution of a program stored in at least one second memory 7*b* by at least one second processor 6*b*.

The group management device 4 includes a third processing circuitry 5*c*. The third processing circuitry 5*c* includes at least one third processor 6*c* and at least one third memory 7*c*. The operation of the group management device 4 is implemented by execution of a program stored in at least one third memory 7*c* by at least one third processor 6*c*.

Next, the operation of the control system will be described by using FIG. 3.

Figure 3:
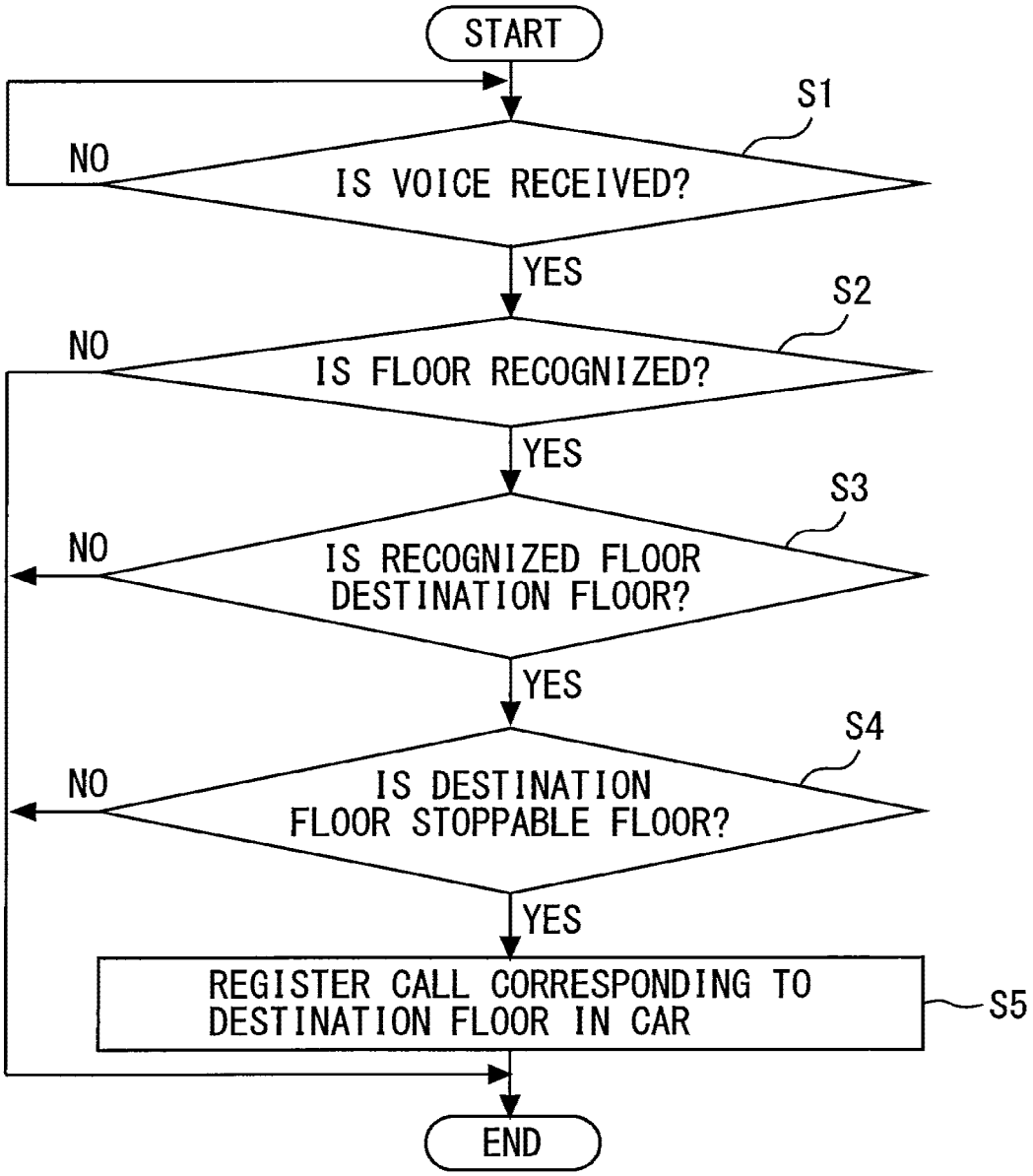
FIG. 3 is a flowchart for explaining the operation of the elevator control system in Embodiment 1 of the invention.

FIG. 3 is a flowchart for explaining the operation of the elevator control system in Embodiment 1 of the invention.

In Step S1, it is determined whether or not the voice input section 1*a* receives the voice during the travel of the car.

In the case where the voice input section 1*a* does not receive the voice in Step S1, Step S1 is repeated. In the case where the voice input section 1*a* receives the voice in Step S1, the flow proceeds to Step S2.

In Step S2, it is determined whether or not the voice recognition section 1*b* recognizes the floor based on the voice input to the voice input section 1*a*. In the case where the voice recognition section 1*b* does not recognize the floor in Step S2, the operation is ended. In the case where the voice recognition section 1*b* recognizes the floor in Step S2, the flow proceeds to Step S3.

In Step S3, the destination floor determination section 1*c* determines whether or not the floor recognized by the voice recognition section 1*b* is the destination floor. In the case where the floor recognized by the voice recognition section 1*b* is not the destination floor in Step S3, the operation is ended. In the case where the floor recognized by the voice recognition section 1*b* is the destination floor in Step S3, the flow proceeds to Step S4.

In Step S4, the stoppable floor determination section 1*d* determines whether or not the destination floor determined by the destination floor determination section 1*c* is the stoppable floor. For example, the stoppable floor determination section 1*d* determines whether or not the destination floor is the stoppable floor before the passage of the car based on the travel state of the car acquired from the control device 3. In the case where the destination floor determined by the destination floor determination section 1*c* is not the stoppable floor in Step S4, the operation is ended. In the case where the destination floor determined by the destination floor determination section 1*c* is the stoppable floor in Step S4, the flow proceeds to Step S5.

In Step S5, the call registration section 1*e* registers the call corresponding to the destination floor in the car. Thereafter, the operation is ended.

According to Embodiment 1 described above, even during the travel of the car, the call corresponding to the destination floor is registered in the car. Accordingly, it is possible to improve operation efficiency of the elevator.

Embodiment 2

Figure 4:
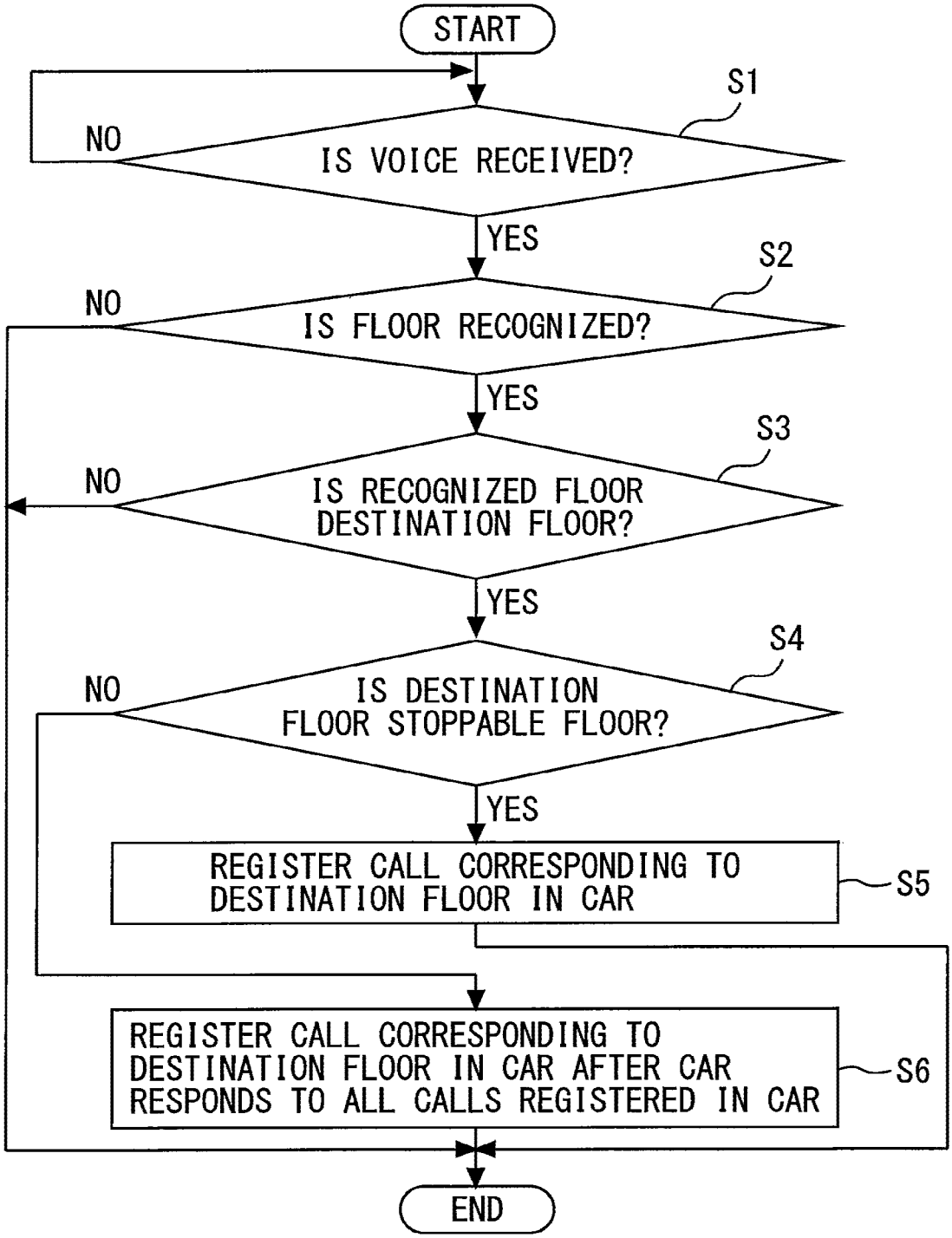
FIG. 4 is a flowchart for explaining the operation of the elevator control system in Embodiment 2 of the invention.

FIG. 4 is a flowchart for explaining the operation of the elevator control system in Embodiment 2 of the invention. Note that parts identical or equivalent to those in Embodiment 1 are designated by the same reference numerals. Description of the parts will be omitted.

In Embodiment 1, in the case where the destination floor determined by the destination floor determination section 1*c* is not the stoppable floor in Step S4, the operation is ended. In contrast to this, in Embodiment 2, in the case where the destination floor determined by the destination floor determination section 1*c* is not the stoppable floor in Step S4, the flow proceeds to Step S6.

In Step S6, the call registration section 1*e* registers the call corresponding to the destination floor in the car after the car responds to all the calls registered in the car. Thereafter, the operation is ended. As a result, the car turns around and starts its travel. During the operation, the destination floor is a floor through which the car passes.

According to Embodiment 2 described above, in the case where the destination floor is not the stoppable floor, the call corresponding to the destination floor is registered in the car after the car responds to all the calls registered in the car. Accordingly, even in the case where the voice input by a user is late, it is possible to cause the car to arrive at the destination floor input by voice. As a result, it is possible to allow the user of which the voice input is late to go to a desired floor.

Embodiment 3

Figure 5:
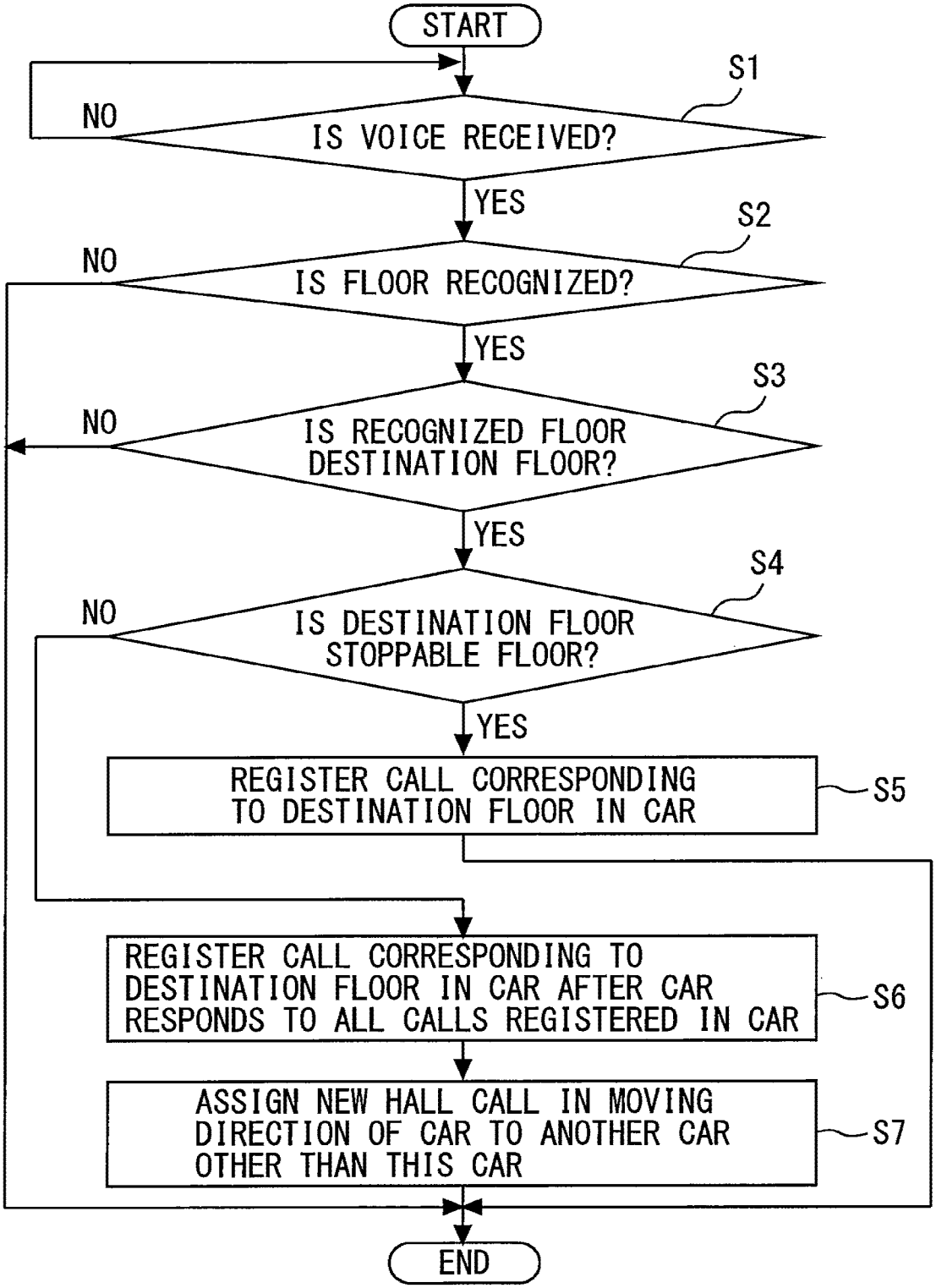
FIG. 5 is a flowchart for explaining the operation of the elevator control system in Embodiment 3 of the invention.

FIG. 5 is a flowchart for explaining the operation of the elevator control system in Embodiment 3 of the invention. Note that parts identical or equivalent to those in Embodiment 2 are designated by the same reference numerals. Description of the parts will be omitted.

In Embodiment 2, after Step S6, the operation is ended. In contrast to this, in Embodiment 3, after Step S6, the flow proceeds to Step S7.

In Step S7, in the case where a new hall call in the moving direction of the car is registered, the group management device 4 assigns the new hall call to a car other this car. Thereafter, the operation is ended.

According to Embodiment 3 described above, in the case where the new hall call in the moving direction of the car is registered, the new hall call is assigned to a car other than this car. Accordingly, it is possible to prevent a time until the car turns around and responds to the destination floor from being prolonged due to the occurrence of the new hall call. As a result, it is possible to allow the user of which the voice input is late to go to the desired floor smoothly.

Embodiment 4

Figure 6:
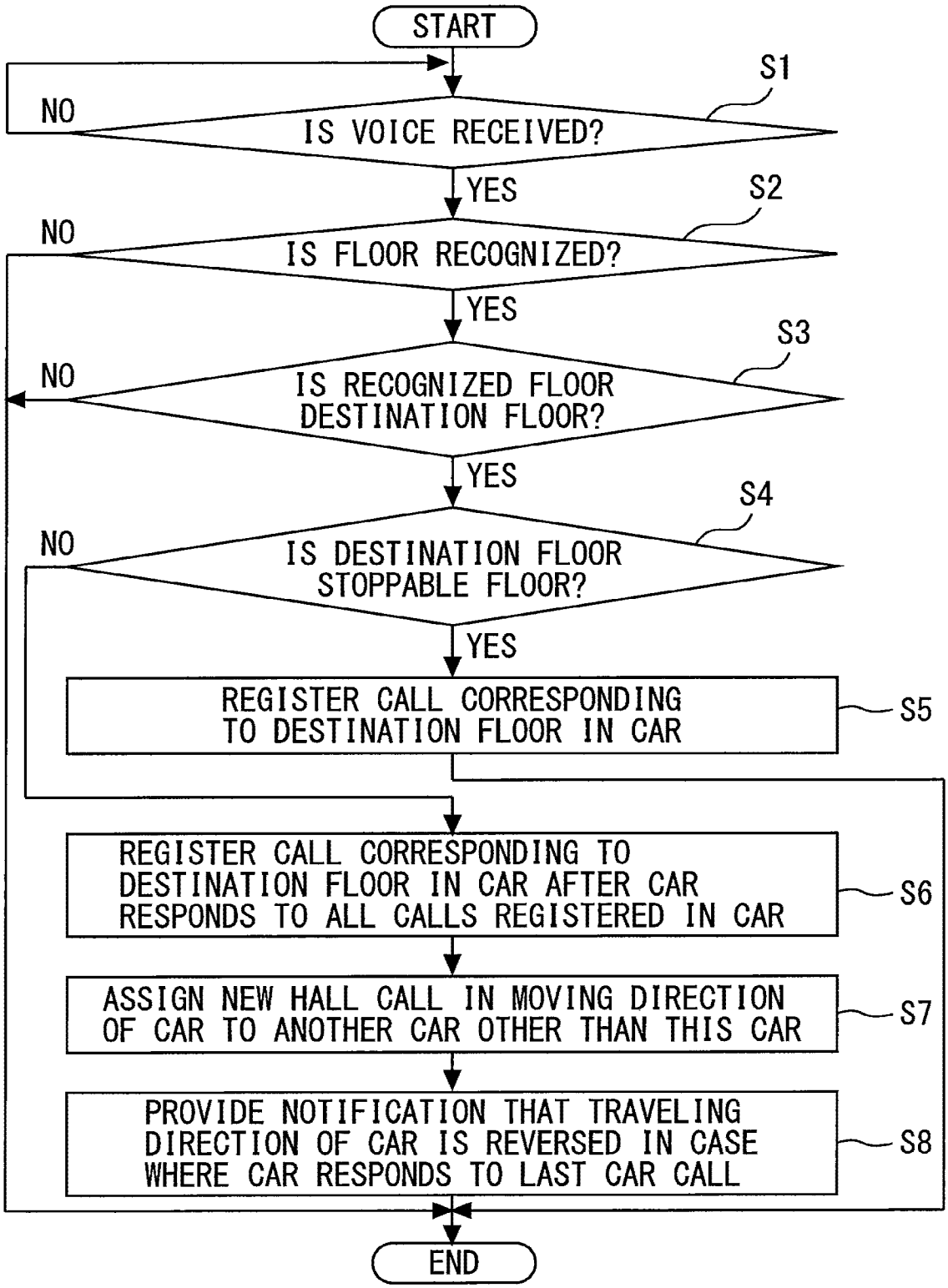
FIG. 6 is a flowchart for explaining the operation of the elevator control system in Embodiment 4 of the invention.

FIG. 6 is a flowchart for explaining the operation of the elevator control system in Embodiment 4 of the invention. Note that parts identical or equivalent to those in Embodiment 3 are designated by the same reference numerals. Description of the parts will be omitted.

In Embodiment 3, after Step S7, the operation is ended. In contrast to this, in Embodiment 4, after Step S7, the flow proceeds to Step S8.

In Step S8, in the case where the car responds to the last call of all the calls registered in the car, the notification device 2 provides a notification that the traveling direction of the car is reversed at the floor corresponding to the last call. For example, in the case where the notification device 2 is a hall lantern, the notification device 2 reverses display of a direction lamp. For example, in the case where the notification device 2 is a speaker, the notification device 2 outputs information that the traveling direction of the car is reversed by voice.

According to Embodiment 4 described above, the notification device 2 provides the notification that the traveling direction of the car is reversed in the case where the car responds to the last call. Accordingly, it is possible to prevent the user in the hall of the floor corresponding to the last car call from getting on the car by mistake.

Embodiment 5

Figure 7:
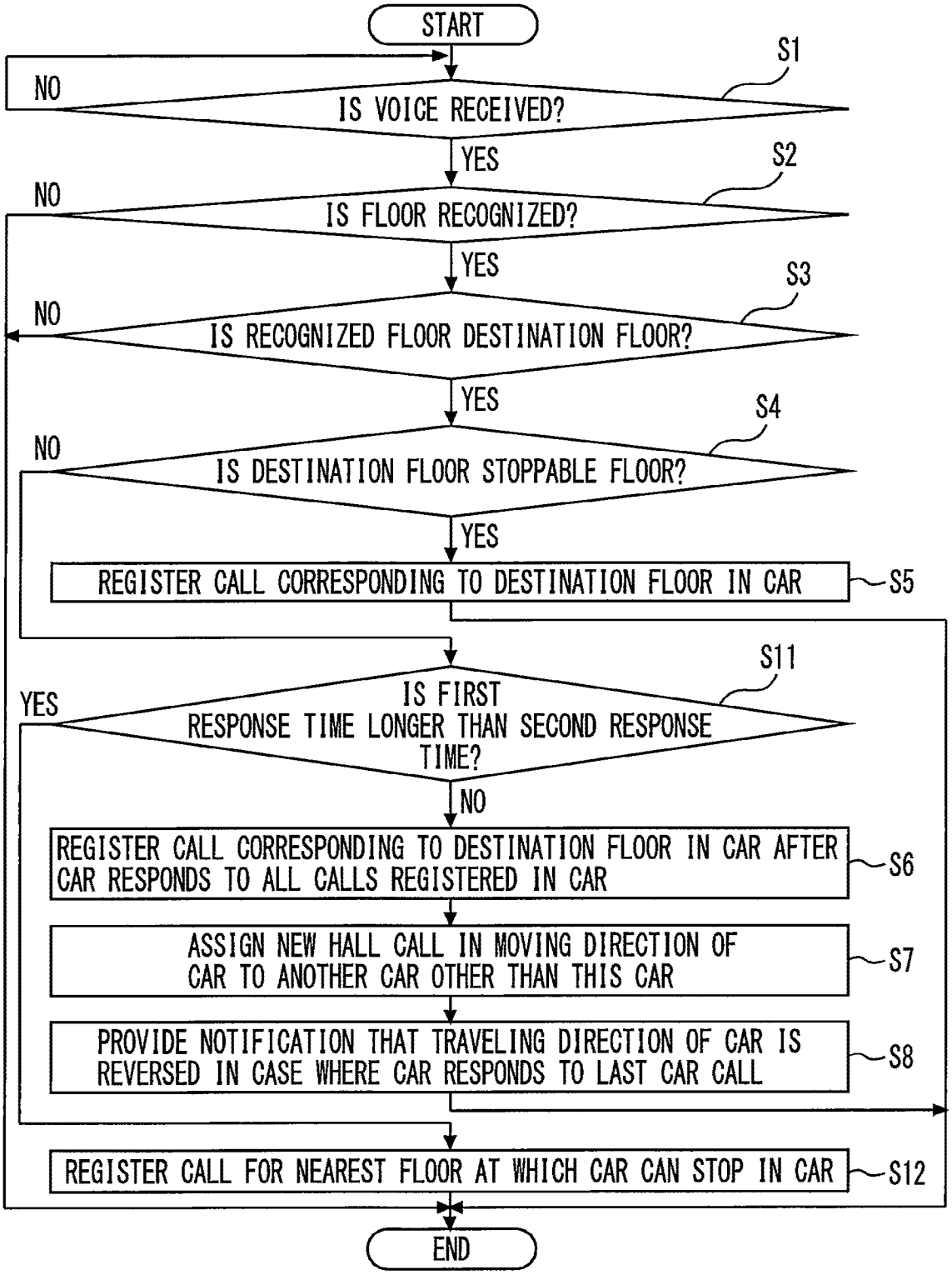
FIG. 7 is a flowchart for explaining the operation of the elevator control system in Embodiment 5 of the invention.

FIG. 7 is a flowchart for explaining the operation of the elevator control system in Embodiment 5 of the invention. Note that parts identical or equivalent to those in Embodiment 4 are designated by the same reference numerals. Description of the parts will be omitted.

In Embodiment 4, in the case where the destination floor determined by the destination floor determination section 1*c* is not the stoppable floor in Step S4, the flow proceeds to Step S6. In contrast to this, in Embodiment 5, in the case where the destination floor determined by the destination floor determination section 1*c* is not the stoppable floor in Step S4, the flow proceeds to Step S11.

In Step S11, the response time estimation section 1*f* estimates a first response time until the car arrives at the destination floor after the car responds to all the calls registered in the car. At this point, the group management device 4 estimates a second response time until the user arrives at the destination floor in the case where the user gets off the car at the nearest floor at which the car can stop and transfers to another car.

The response time estimation section 1*f* determines whether or not the first response time is longer than the second response time. In the case where the first response time is shorter than the second response time, the flow proceeds to Step S6. In the case where the first response time is longer than the second response time, the flow proceeds to Step S12.

In Step S12, the call registration section 1*e* registers the call for the nearest floor at which the car can stop in the car. Thereafter, the operation is ended.

According to Embodiment 5 described above, in the case where the first response time is longer than the second response time, the call for the nearest floor at which the car can stop is registered in the car. Accordingly, it is possible to allow the user of which the voice input is late to go to the desired floor more quickly.

Embodiment 6

Figure 8:
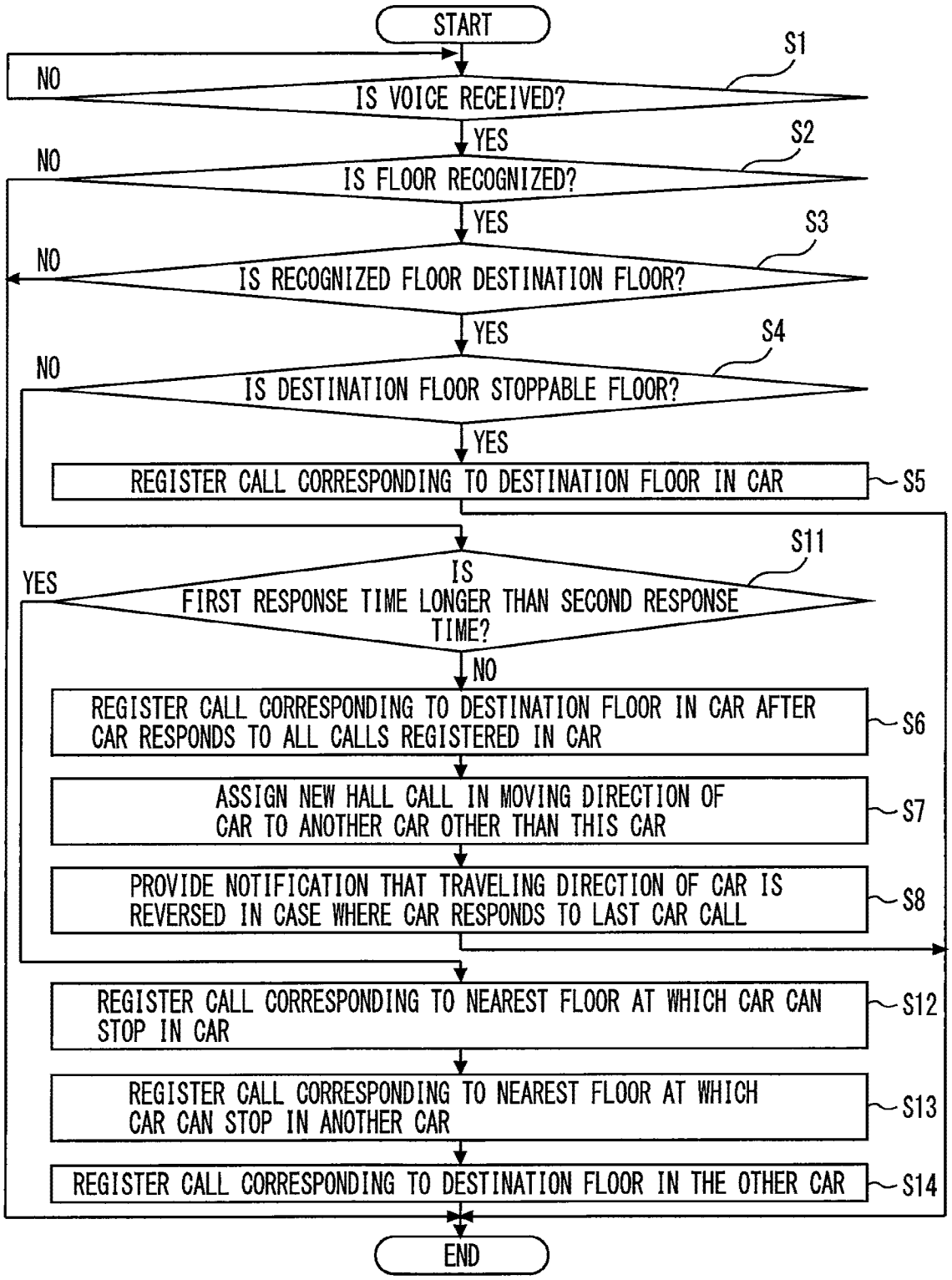
FIG. 8 is a flowchart for explaining the operation of the elevator control system in Embodiment 6 of the invention.

FIG. 8 is a flowchart for explaining the operation of the elevator control system in Embodiment 6 of the invention. Note that parts identical or equivalent to those in Embodiment 5 are designated by the same reference numerals. Description of the parts will be omitted.

In Embodiment 5, after Step S12, the operation is ended. In contrast to this, in Embodiment 6, after Step S12, the flow proceeds to Step S13.

In Step S13, the group management device 4 registers the call corresponding to the nearest floor at which the car can stop in another car. Thereafter, the flow proceeds to Step S14. In Step S14, the group management device 4 assigns the call corresponding to the destination floor to the other car. Thereafter, the operation is ended.

According to Embodiment 6 described above, in the case where the first response time is longer than the second response time, the call corresponding to the nearest floor is registered in the other car. Thereafter, the call corresponding to the destination floor is registered in the other car. Accordingly, it is possible to allow the user of which the voice input is late to go to the desired floor more quickly and more reliably.

Embodiment 7

Figure 9:
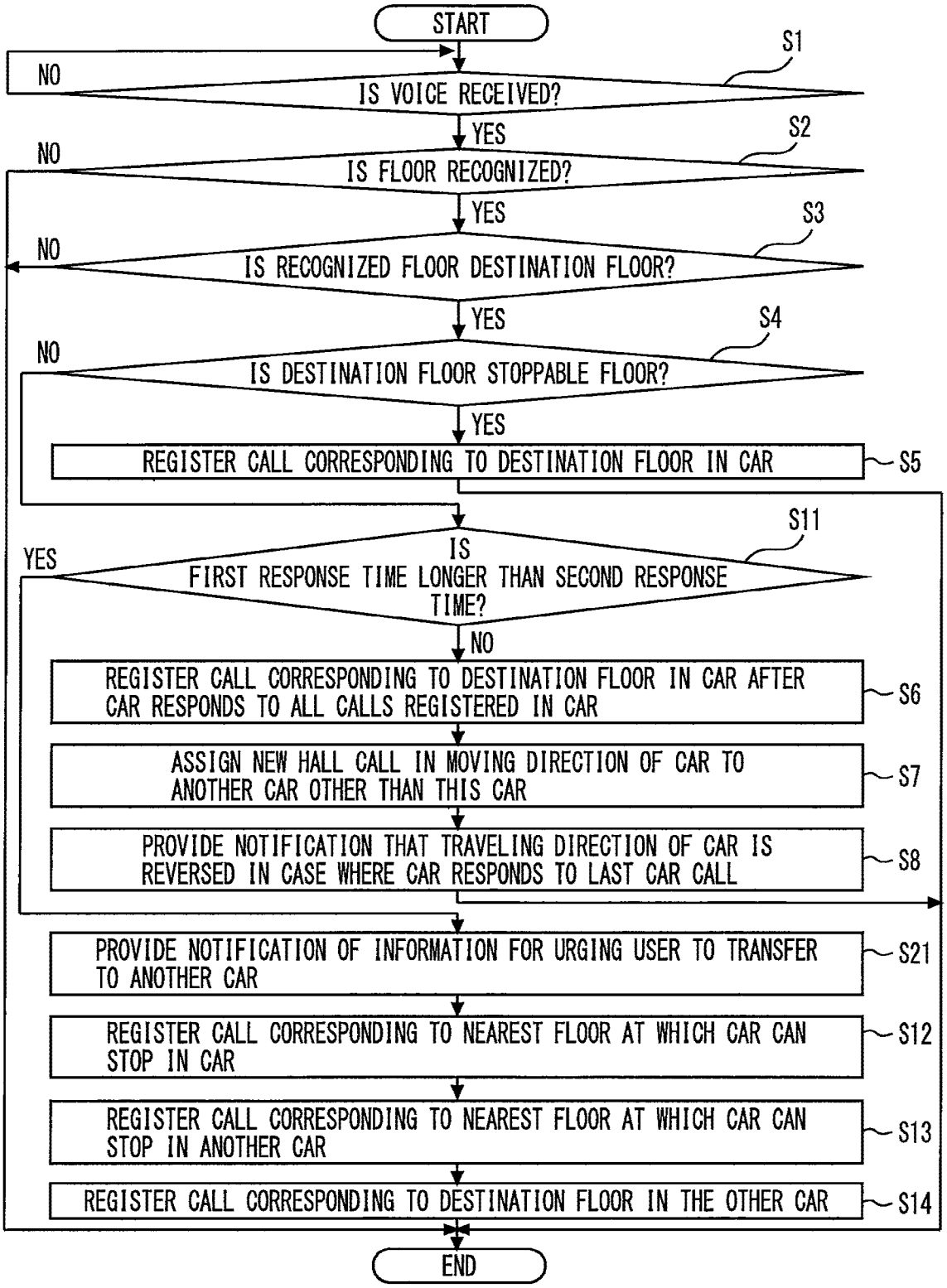
FIG. 9 is a flowchart for explaining the operation of the elevator control system in Embodiment 7 of the invention.

FIG. 9 is a flowchart for explaining the operation of the elevator control system in Embodiment 7 of the invention. Note that parts identical or equivalent to those in Embodiment 6 are designated by the same reference numerals. Description of the parts will be omitted.

In Embodiment 6, after Step S11, the flow proceeds to Step S12. In contrast to this, in Embodiment 7, after Step S11, the flow proceeds to Step S21.

In Step S21, the notification section 1*g* notifies the user who desires to go to the destination floor of information for urging the user to get off at the nearest floor at which the car can stop and transfer to another car. For example, the notification section 1*g* provides the notification of the information by display or by voice. Thereafter, the flow proceeds to Step S12.

According to Embodiment 7 described above, the notification section 1*g* provides the notification of the information for urging the user to get off at the nearest floor at which the car can stop and transfer to another car. Accordingly, it is possible to urge the user who desires to go to the destination floor to transfer to another car more reliably.

INDUSTRIAL APPLICABILITY

Thus, the elevator control system according to the invention can be used in the system that improves the operation efficiency of the elevator.

REFERENCE SIGNS LIST

1 Car control panel
1*a* Voice input section

1*b* Voice recognition section
1*c* Destination floor determination section
1*d* Stoppable floor determination section
1*e* Call registration section
1*f* Response time estimation section
1*g* Notification section
2 Notification device
3 Control device
4 Group management device
5*a* First processing circuitry
5*b* Second processing circuitry
5*c* Third processing circuitry
6*a* First processor
6*b* Second processor
6*c* Third processor
7*a* First memory
7*b* Second memory
7*c* Third memory

The invention claimed is:

1. An elevator control system comprising:
a processor to execute a program; and
a memory to store the program which, executed by the processor, performs processes of,
recognizing a floor based on voice information from in a car of an elevator during travel of the car,
determining a destination floor based on the floor recognized,
determining whether or not the destination floor determined during the travel of the car is a stoppable floor in a travel direction, and
registering a call corresponding to the destination floor in the car during the travel of the car in a case where the destination floor is determined to be the stoppable floor,
wherein the program, executed by the processor, performs processes of,
in a case where the destination floor is not determined to be the stoppable floor, registering the call corresponding to the destination floor in the car after the car responds to all calls registered in the car.

2. The elevator control system according to claim 1, further comprising
a group management device configured to assign, in a case where a new hall call in a moving direction of the car is registered after the call corresponding to the destination floor is registered in the car after the car responds to all the calls registered in the car, the new hall call to a car other than this car.

3. The elevator control system according to claim 2, further comprising:
a notification device configured to provide, in a case where the car responds to a last call of all the calls registered in the car, a notification that a traveling direction of the car is reversed in a hall of a floor corresponding to the last call.

4. The elevator control system according to claim 2
wherein the program, executed by the processor, performs processes of estimating a first response time until the car arrives at the destination floor in a case where the call corresponding to the destination floor is registered in the car after the car responds to all the calls registered in the car and in a case where the first response time estimated is longer than a second response time until a user arrives at the destination floor when the user gets of the car at a nearest floor at which the car can stop and transfers to another car, the call registration section registers a call for the nearest floor at which the car can stop in the car.

5. The elevator control system according to claim 4, wherein in the case where the first response time estimated is longer than the second response time until the user arrives at the destination floor when the user gets off the car at the nearest floor at which the car can stop and transfers to another car, the group management device registers the call for the nearest floor and a call for the destination floor in the other car.

6. The elevator control system according to claim 5,
wherein the program, executed by the processor, performs processes of notifying, in the case where the first response time estimated is longer than the second response time until the user arrives at the destination floor when the user gets off the car at the nearest floor at which the car can stop and transfers to another car, the user who desires to go to the destination floor of information for urging the user to get off at the nearest floor at which the car can stop and transfer to the other car.

7. An elevator control system comprising:
processing circuitry configured to
recognize a floor based on voice information from within a car of an elevator during travel of the car
determine a destination floor based on the floor recognized,
determine whether or not the destination floor determined during the travel of the car is an upcoming floor in a travel direction, and
register a call corresponding to the destination floor in the car during the travel of the car in a case in which the destination floor is determined to be the upcoming floor,
wherein the processing circuitry is further configured to
in a case in which the destination floor is not determined to be the upcoming floor, register the call corresponding to the destination floor in the car after the car responds to all calls registered in the car.

8. An elevator control system comprising:
processor to execute a program;
a memory to store the program which, executed by the processor, performs processes of,
recognizing a floor based on voice information from in a car of an elevator during travel of the car,
determining a destination floor based on the floor recognized,
determining whether or not the destination floor determined during the travel of the car is a stoppable floor in a travel direction, and
registering a call corresponding to the destination floor in the car during the travel of the car in a case where the destination floor is determined to be the stoppable floor,
wherein the program, executed by the processor, performs processes of,
in a case where the destination floor is not determined to be the stoppable floor, registering the call corresponding to the destination floor in the car after the car responds to all calls registered in the car; and
a group management device configured to assign, in a case where a new halt call in a moving direction of the car is registered after the call corresponding to the destination floor is registered in the car after the car responds to all the calls registered in the car, the new hall call to a car other than this car.

9. The elevator control system according to claim 8, further comprising:
a notification device configured to provide, in a case where the car responds to a last call of all the calls registered in the car, a notification that a traveling direction of the car is reversed in a hall of a floor corresponding to the last call.

10. The elevator control system according to claim 8, wherein the program, executed by the processor, performs processes of estimating a first response time until the car arrives at the destination floor in a case where the call corresponding to the destination floor is registered in the car after the car responds to all the calls registered in the car and in a case where the first response time estimated is longer than a second response time until a user arrives at the destination floor when the user gets off the car at a nearest floor at which the car can stop and transfers to another car, the call registration section registers a call for the nearest floor at which the car can stop in the car.

11. The elevator control system according to claim 10, wherein in the case where the first response time estimated is longer than the second response time until the user arrives at the destination floor when the user gets off the car at the nearest floor at which the car can stop and transfers to another car, the group management device registers the call for the nearest floor and a call for the destination floor in the other car.

12. The elevator control system according to claim 11, wherein the program, executed by the processor, performs processes of notifying, in the case where the first response time estimated is longer than the second response time until the user arrives at the destination floor when the user gets off the car at the nearest floor at which the car can stop and transfers to another car, the user who desires to go to the destination floor of information for urging the user to get off at the nearest floor at which the car can stop and transfer to the other car.

* * * * *